United States Patent [19]

Eckert

[11] 4,334,875

[45] Jun. 15, 1982

[54] PROCESS FOR FORMING A SLEEVE BY WINDING AND A DEVICE FOR EXECUTING THE METHOD

[75] Inventor: Eugen Eckert, Holm, Fed. Rep. of Germany

[73] Assignees: Maschinenfabrik Rissen GmbH, Hamburg; 4P Nicolaus Kempten GmbH, Kempten, both of Fed. Rep. of Germany

[21] Appl. No.: 142,142

[22] Filed: Apr. 14, 1980

[30] Foreign Application Priority Data

Apr. 28, 1979 [DE] Fed. Rep. of Germany ..... 2917304

[51] Int. Cl.[3] ..... B31C 1/00

[52] U.S. Cl. ..... 493/303; 493/107; 493/112

[58] Field of Search ..... 493/303, 107, 112, 305–307, 493/105–106, 108

[56] References Cited

U.S. PATENT DOCUMENTS

| | | | |
|---|---|---|---|
| 1,065,680 | 6/1913 | Grissinger | 493/303 X |
| 1,082,836 | 12/1913 | Whitney | 493/107 |
| 1,187,063 | 6/1916 | Herr | 493/303 X |
| 2,548,451 | 4/1951 | Tribbey | 493/303 X |

*Primary Examiner*—James F. Coan

*Attorney, Agent, or Firm*—Michael J. Striker

[57] ABSTRACT

A process and device forms a sleeve from a flat, rectangular blank by winding the blank around a mandrel after it has been clamped to the mandrel surface and where the clamp passes under a presser member due to the lifting of the presser member by the action of a cam. The sleeve is permanently formed by a sealing of the blank edges upon the mandrel by a sealing member.

5 Claims, 4 Drawing Figures

PROCESS FOR FORMING A SLEEVE BY WINDING AND A DEVICE FOR EXECUTING THE METHOD

BACKGROUND OF THE INVENTION

The invention relates to a process, and a device which performs the process, for forming a sleeve from a flat, rectangular, or similarly shaped, blank, particularly a blank composed of cardboard by winding the blank upon a winding mandrel which is equipped with a clamp that secures the leading edge of the blank and a presser member that presses the blank against the outer surface of the mandrel during most of the winding process.

In the known processes of this art the leading edge of the blank is held by a clamp located in a recess in the mandrel surface.

This process has the disadvantage of inwardly bending the leading edge of the blank thus frequently causing a permanent inwardly turned deformation in the finished product. Further the leading edge of the blank in such processes is covered by the clamp, thus preventing the leading edge from being sealed in conjunction with the trialing end of the blank.

This disadvantage is eliminated by pneumatic suction processes which hold the leading edge with suction. However, this type of process is usable only with material of limited thickness and only of use with mandrels of a certain minimum diameter.

SUMMARY OF THE INVENTION

It is the objective of the invention to overcome these disadvantages in the prior art, particularly the inward bending of the leading blank edge. This problem is solved according to the invention by equipping the mandrel with a clamp which presses the blank directly against the mandrel and rotates together with the mandrel. This rotation is facilitated by the action of the presser member in that it is separated from the mandrel surface for a short period of time during which the clamp passes under the presser member once for each manufacturing cycle.

The presser member must press the blank against the winding mandrel to guarantee the proper winding stress. The presser member is forced against the mandrel by spring force. This pressing must be continuous and that is the reason that the known devices place the clamp beneath the winding mandrel surface so that the clamp does not interfere with the presser member. In the present invention this required continuity of force is not interrupted to allow the clamp to pass under the presser member, since the presser member is lifted only long enough to permit the clamp securing the leading edge to pass under the presser member, after which the presser member is lowered and the pressure is thereafter continuously maintained, until the completion of the manufacturing cycle, so that any undesired deformation or stretching on the sleeve is so slight as to be insignificant.

In this manner the advantage of clamping the leading edge without the undesired inward bending is obtained. An additional aspect of the invention consists in permitting a small portion of the leading edge to remain free so that a sealed seam may be formed without damage or waste.

A device for advantageously practicing this process consists of a winding mandrel with a rotary clamp affixed thereto and arranged so that the clamp presses against the outer circumferential surface of the winding mandrel. Further, a presser member is positioned so that it presses against the mandrel surface, and is provided with means for being raised sufficiently to permit the clamp to pass under it after which it is once again lowered into contact with the mandrel surface.

Different control mechanisms for effecting separation of the presser member and the mandrel are conceivable, e.g. a control sensor on the mandrel controlling the delivering of a specific impulse to the presser member. A preferred embodiment of this invention uses a cam attached to the mandrel to effect the lifting and lowering of the presser member which is kept under spring pressure to force the lowering of the presser member at the proper moment. This lifting is advantageously accomplished by placing a lifting shaft on the presser member so that the cam acts upon the lifting shaft which then causes the member to rise.

Another aspect of the invention is placing the presser member and the clamp equidestant from a sealing member upon completion of the winding so that the portion of blank to be sealed is held by both the presser member and the clamp when the sealing member is lowered to effect the permanent joining of the edges.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWINGS

FIG. 1 is a schematic view of the device as the leading edge enters the clamp;

FIG. 2 is a schematic view of the device after the leading edge is clamped;

FIG. 3 is a schematic view of the device showing the lifting of the presser member; and FIG. 4 is a schematic view of the device showing the relation between the clamp and presser member as the sealing member is about to function.

DESCRIPTION OF THE PREFERRED EMBODIMENTS

Figure 1:
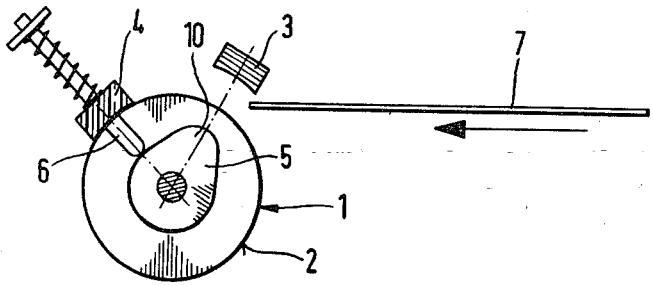
FIG. 1 through FIG. 4 show the operation of the device at various stages, more specially.
Figure 2:
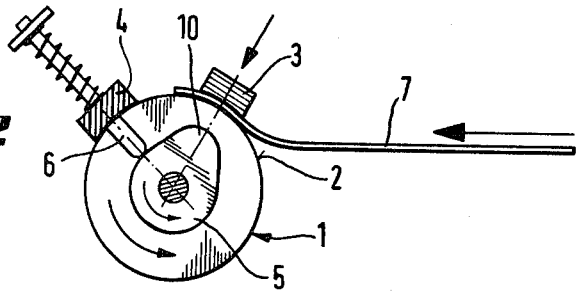

As shown in FIG. 1 the rotatable mandrel 1 having a circumferential surface 2 is equipped with a clamp 3. Clamp 3 is able to simultaneously press against the circumferential surface 2 and rotate with mandrel 1. The clamp is lifted to allow the leading edge of the blank 7 to enter between the clamp and the mandrel. The clamp is then lowered as shown in FIG. 2, securing the blank edge. A small portion of the leading edge is allowed to remain free beyond the reach of the clamp as shown in FIG. 2. A presser member 4 is stationary with respect to the mandrel 1 and is spring loaded so that it presses against the blank 7 as the blank 7 is wound on the circumferential surface 2. This presser member is moved normal to the mandrel surface by a rotary cam 5 with a cam lobe 10 illustrated in FIG. 3.

Figure 3:
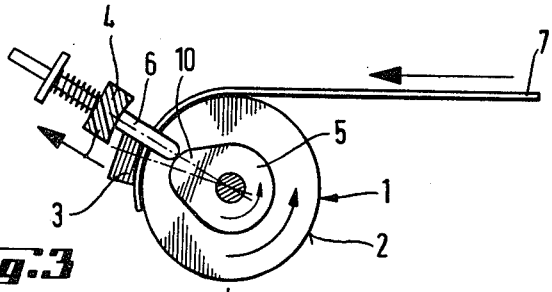
Figure 4:
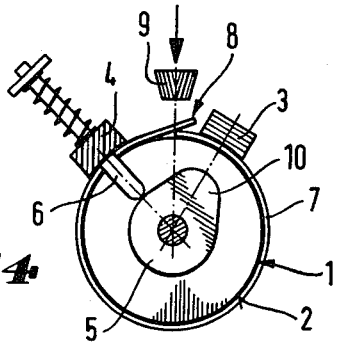

The manner in which the device functions can be seen from the figures. In FIG. 1 the clamp 3 is separated from the mandrel 1 so that the blank 7 may pass between the clamp and mandrel. In FIG. 2 the blank 7 is clamped in such a way that a small part of its leading edge portion is beyond the clamp and the trailing edge is free. In FIG. 3 the mandrel 1 has rotated to a position where the cam lobe 10 of cam 5 has forced the presser member 4 to separate from the circumferential surface 2 so as to permit the clamp to pass beneath it. The lifting force was delivered from the cam lobe 10 to the presser member 4 by way of a lifting shaft 6. After the clamp 3 has passed beneath the presser member 4 the force of the spring in conjunction with the movement of the cam 5 quickly causes the presser member 4 to return to press against the blank 7 on the circumferential surface 2 so that the blank is placed under a preselected winding stress. In FIG. 4 the sealing member 9 is shown which is lowered to produce a permanent joining of the leading edge and the trailing edge 8 of the blank 7 thereby producing the desired sleeve.

It will be understood that each of the elements described above, or two or more together, may also find a useful application in other types of winding processes and devices differing from the types described above.

While the invention has been illustrated and described as embodied in a winding mandrel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is not forth in the appended claims:

1. A process for forming a sleeve from a flat blank, particularly rectangular cardboard blank, having a leading edge and a trailing edge, by winding the blank around a rotating mandrel having a circumferential surface at least once and utilizing a clamp to secure the leading edge of said blank against said mandrel and a presser member to apply force against said blank during said winding, comprising the steps of clamping the said leading edge of said blank against said circumferential surface of said mandrel; raising said presser member with respect to said mandrel for a limited time interval so that said clamp may pass beneath it; lowering said presser member so that stress is placed upon said blank while it is wound, said raising and lowering ocurring as often as is necessitated by rotations of the clamp; joining said leading edge and said trailing edge together to form a sleeve; and releasing said presser member and said clamp for removal of the sleeve.

2. A device for forming a sleeve from a flat blank, particularly a rectangular cardboard blank, having a leading edge and a trailing edge by winding said blank about a mandrel having a circumferential surface comprising a clamp which rotates together with said mandrel and is operative for securing said leading edge of said blank against said circumferential surface of said mandrel; and a presser member operative for pressing said blank against said circumferential surface and operative for being lifted from said circumferential surface for a time interval sufficient to enable said clamp to pass beneath it.

3. A device as defined in claim 2, further comprising a cam permanently affixed to said mandrel and operative to lift said presser member.

4. A device as defined in claim 3, further comprising a lifting shaft operative to lift said presser member in response to contact with said cam.

5. A device as defined in claim 2, further comprising a sealing member operative for permanently joining said leading edge and said trailing edge of said blank.

* * * * *